United States Patent [19]

Jackson

[11] Patent Number: 4,625,672

[45] Date of Patent: Dec. 2, 1986

[54] SAIL TENSION CONTROL MECHANISM

[76] Inventor: Gregg B. Jackson, 721 Upshur St. N.W., Washington, D.C. 20011

[21] Appl. No.: 674,032

[22] Filed: Nov. 23, 1984

[51] Int. Cl.[4] ..... G63H 9/00

[52] U.S. Cl. ..... 114/111; 114/102; 114/108

[58] Field of Search ..... 114/102, 108, 109, 111-115

[56] References Cited

U.S. PATENT DOCUMENTS

| | | | |
|---|---|---|---|
| 403,257 | 5/1889 | Falck | 114/111 |
| 663,509 | 12/1900 | McKey | 114/111 |
| 3,464,378 | 9/1969 | Veltman | 114/102 |
| 3,820,493 | 6/1974 | Amick | 114/102 |
| 4,059,063 | 11/1977 | Hood | 114/102 |
| 4,061,099 | 12/1977 | Cook | 114/111 |
| 4,503,797 | 3/1985 | Maurin | 114/102 |

OTHER PUBLICATIONS

Photos of Slingshot, *Technology Illustrated,* p. 43, Jul. 1983, USA.

*Primary Examiner*—Trygve M. Blix
*Assistant Examiner*—C. T. Bartz

[57] ABSTRACT

An automated sail tension control system has a cunningham, outhaul, and vang that are automatically tensioned and eased, as the boom is sheeted in and out, respectively, on either side of the sailing vessel. The system comprises: a mast; a boom connected at its forward end to the mast; a vertical axis of pivot for the boom at its connection with the mast; a cunningham and outhaul that are led from points on the boom substantially aft of the vertical axis of pivot to points on the mast or deck that are substantially forward of or laterally from a projection of the vertical axis of pivot; and a vang whose lower end is usually mounted somewhat forward of a projection of the vertical axis of pivot or on an arced means that allows it to slide laterally more than fore and aft.

21 Claims, 8 Drawing Figures

SAIL TENSION CONTROL MECHANISM

BACKGROUND OF THE INVENTION

The present invention generally relates to sailing vessels and more particularly to means for automatically adjusting the tension of the luff, foot, and leech of a mast-rigged sail while under way.

The camber of a sail seriously affects the speed with which it will propel a vessel. The optimum camber depends on many factors including the size, shape, and potential speed of the vessel; sea conditions, for waterborne vessels; the wind velocity; and the angle to the wind at which the vessel is sailing. The camber is partly determined during manufacture of the sail, but is also substantially affected by the tension on its luff, foot, and leech while in operation.

Current practice is to make adjustments to a mast-rigged sail manually, and separately for each of the three sides of the sail. The sail is held at the top of the mast with a halyard, which is not adjusted while under way.

A cunningham, a line secured to the tack of the sail and led downward, is commonly used to adjust the tension along the luff. Alternatively, the tack of the sail is secured to the front of the boom; the boom is attached to the mast on a vertical slide means; and a downhaul, a line secured to the front of the boom and led downward, is used to adjust the tension along the luff.

An outhaul, a line secured to the clew of the sail and led to about the distal end of the boom, is used to adjust the tension along the foot of the sail.

The tension along the leech of a sail is adjusted by several means. When the vessel is beating, the primary means usually is the sheetline to the boom. When the vessel is off the wind, the primary means usually is the vang. In addition, adjustments of the outhaul and headstay, and deflection of the mast, affect the leech tension.

The optimal camber for a sail is generally achieved by increasing the tensions along the luff, foot, and leech as the vessel heads closer into the wind, and reducing these tensions as the vessel heads farther away from the wind. In addition, as the wind velocity increases, the tensions should be increased; and as the wind drops, the tensions should be reduced. It is not uncommon in racing vessels for the crew to make 10 or 15 adjustments to the sail tensions each hour.

A few prior art vessels have automatic adjustment of the tension along the foot of a sail for changes in the heading of the vessel. The forward end of the boom is mounted on the deck substantially aft of the mast. Since the sail's vertical axis of pivot is along the transverse center of the aft edge of the mast, this makes the boom eccentric to the sail in the horizontal plane. As the boom is sheeted out, the distal end of the boom gradually moves closer to the aft edge of the mast, thus easing the tension along the foot of the sail. These deck-mounted booms increase the stresses on the deck, require vangs to be the expensive radiused type, and usually present serious inconveniences and hazards to the crew.

On modern sailing vessels the boom is almost always mounted to the aft edge of a mast some distance above the deck. The mounting means, a gooseneck, is a pivoting mechanism that includes a vertical axis so that the boom can rotate in a horizontal plane and a transverse axis so that the boom can rotate in a vertical plane. The vertical axis is as close to the mast as convenient for its construction. In vessels of ten to twenty feet in length, that is about three-quarters of an inch. In larger vessels it is correspondingly farther, but still relatively close to the mast. To set the vertical axis of a gooseneck substantially aft of the mast creates structural complications, aesthetic problems, and considerable torsional stress on the mast when the boom is sheeted out.

Prior art boom vangs often make small adjustments to the tension of the leech automatically in response to sheeting the boom in and out. For them not to, the lower end of the vang must be secured directly on a projection of the boom's vertical axis of pivot or on a semicircular fitting centered directly about the projection. If the vang is secured a half inch forward of the boom's vertical axis of pivot, as it may be for structural or other reasons, the vang will be eccentric to the boom, and in such a manner that as the boom is sheeted out the vang will reduce the tension on the leech. If, however, the vang is secured a half of an inch aft, there will be an eccentricity such that as the boom is sheeted out the vang will increase the tension on the leech, rather than reduce it. In addition, when the lower end of the vang is secured to a transversely disposed bale, the arc of the fitting often allows the vang to slide on the bale more laterally than forward and aft, and this results in some easing of the leech tension as the boom is sheeted out. The amount of automatic adjustment of the leech tension caused by these small geometric asymmetries is usually quite modest, and often unrecognized by sailors. Manual adjustment of the vang is almost universal in racing vessels.

Individual manual adjustments of the luff, foot, and leech tensions are often difficult to do as accurately as desired. They require the crew to move their weight temporarily to positions that are otherwise not preferred. They are usually done less frequently and less promptly than wished because of the crew's preoccupation with other matters. And when being done, they distract the crew's attention from other responsibilities. At best, they are a hassle for the crew; at worst, they impede optimal functioning of the vessel.

SUMMARY OF THE INVENTION

The present invention is a mechanism that automatically adjusts the tension along the luff, foot, and leech of a mast-rigged sail, for different headings of a sailing vessel. It also provides limited adjustment of those tensions for changes in wind velocity. The tensions are increased as the vessel is headed closer to the wind and the boom is properly sheeted in, and decreased as the vessel is headed farther off from the wind and the boom is properly sheeted out. The magnitude of the adjustments can be close to what is needed for maintaining optimal camber in the sail over the full range of course headings.

The adjustments are achieved automatically and immediately in response to sheeting the boom in or out. They are achieved without any special attention from the crew and without any movement of the crew weight from the preferred position. Fine adjustments are effected for small changes in the boom's horizontal angle. The equipment for securing the individual tension control lines can sometimes be lighter and less expensive than needed for frequent manual adjustments. The additional equipment needed is of low cost and easily retrofitted to existing boats.

The present invention comprises: a mast; a boom connected at its forward end to the mast; a vertical axis of pivot for the boom at its connection with the mast; at least one radial line restraining means on the boom substantially aft of its vertical axis of pivot; at least one eccentric line restraining means disposed substantially forward and/or laterally from the boom's vertical axis of pivot; and at least one sail tension line, such as a cunningham or outhaul, led between the radial line restraining means and the eccentric line restraining means, such that as the boom is sheeted in and out, on either side of the sailing vessel, the sail tension line(s) are substantially tensioned and eased, respectively. The invention also can include a vang means for automatically adjusting the tension along the leech of a sail, so that, in conjunction with all the vessel's other equipment, the leech is substantially tensioned and eased, as the boom is sheeted in and out.

DESCRIPTION OF THE PREFERRED EMBODIMENTS

For the specification herein, references to "forward," "aft," and the like, will be with the presumption that the boom of the sailing vessel is sheeted in almost parallel to the longitudinal axis of the vessel, as it normally is for beating to windward. Similarly, references to "vertical," "horizontal," "under," and the like will be with the presumption that the vessel is disposed vertically in its upright position.

An "eccentric line restraining means," "eccentric block," and "eccentric cleat" are to be understood as disposed either about directly abreast of the vertical axis of pivot of the boom or forward of that. A "radial line restraining means," "radial channel guide," "radial block," and "radial cleat" are to be understood as disposed on the boom aft of its vertical axis of pivot. A line restraining means disposed "substantially" from the vertical axis of pivot is to be at a distance of more than two percent of the boom's length.

A single "line restraining means" is to include means that can restrain more than one line or one line more than once, such as a double sheave block or a single sheave block with a becket. A line "led to" a line restraining means can pass through the means, be secured by the means, be secured to the means, or in any other way restrained by the means. A "cunningham" is to include what is generally referred to as a "downhaul." A sail tension line is "substantially tensioned and eased" when the end attached to the sail moves a distance of more than two percent of the boom's length as the boom is sheeted in and out over a ninety degree arc between parallel and perpendicular to the longitudinal axis of the vessel.

Suggested distances for the positioning of key elements will be stated for a fifteen-foot boat with a nine-foot boom. These distances should be scaled up or down proportionately for boats of other sizes.

Figure 1:
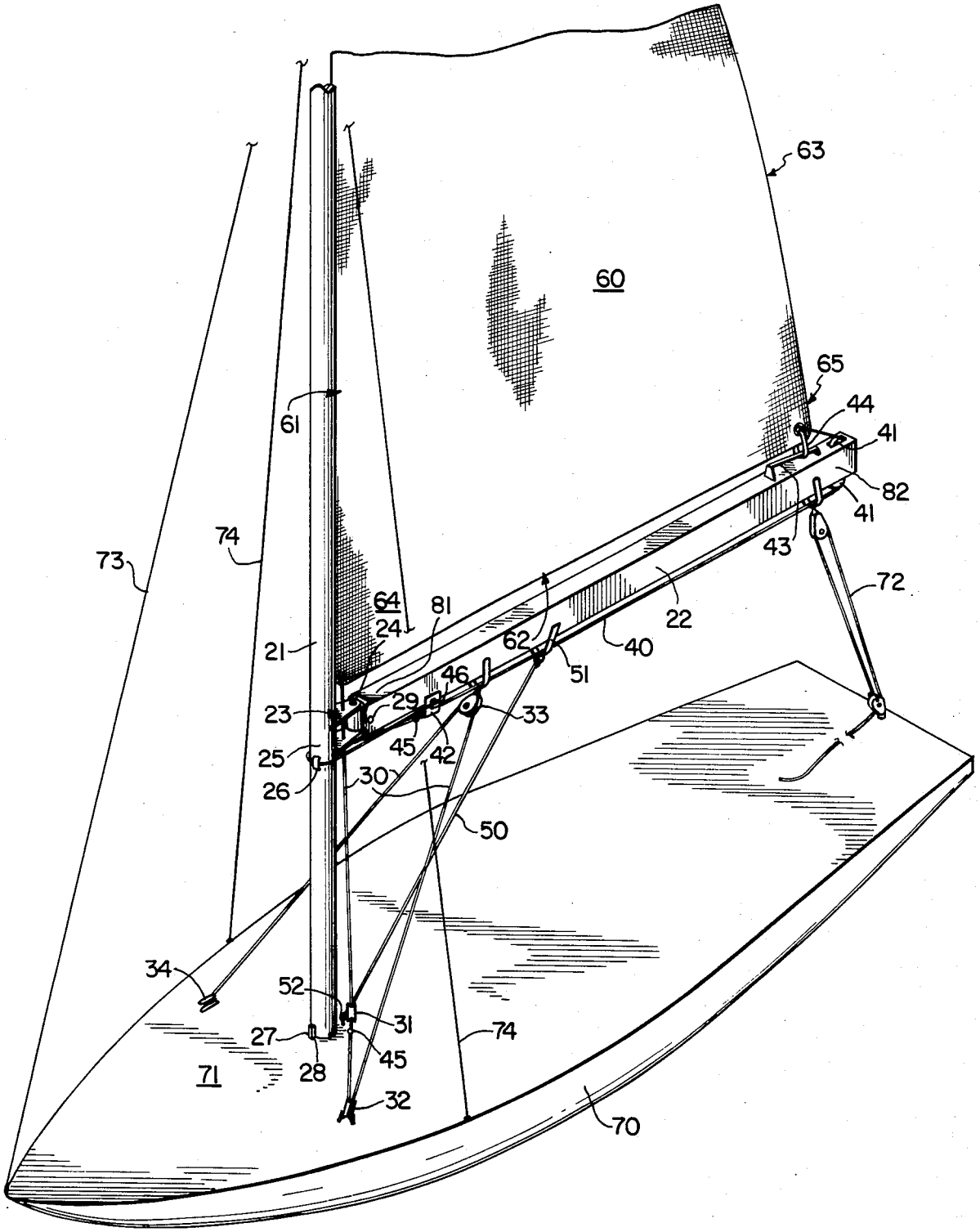
FIG. 1 is a perspective view of a preferred embodiment of the present invention, installed on a boat.

A preferred embodiment of the present invention for a sailing vessel is shown in FIG. 1 mounted on a boat. The cunningham and outhaul arrangements of FIG. 1 are shown schematically in FIGS. 7 and 8, respectively. The automated sail tension control system principally comprises two automated sail tension control mechanisms, an automated cunningham control mechanism and an automated outhaul control mechanism, and a vang means. The first mechanism uses a specially rigged cunningham 30. The second uses a specially rigged outhaul 40. And the vang means uses a carefully selected mount for the lower end of a vang 50.

The mast 21, round in this case, has a key 27 affixed to it; the key 27 fits into an indentation 28 in the mast step to prevent the mast from rotating in the step. The boom 22 is connected at its forward end 81 to the mast 21 with a gooseneck 23 that provides a vertical axis of pivot 24 and a transverse axis of pivot 29 for the boom 22. Preferably the vertical axis of pivot 24 is about one and one-half inches aft of the aft edge of the mast, rather than the normal three-quarters of an inch.

A sail tension line, a cunningham 30, is led from the tack 64 of a loose-footed sail 60 down through the gooseneck 23 to central line restraining means, in this case a central block 31; then to an eccentric line restraining means, a port eccentric block 32; then to a radial line restraining means on the boom, a radial block 33; and then to another eccentric line restraining means, a starboard cleat 34. The central block 31 is about directly below the tack 64 of the sail and is mounted on the deck 71 of a boat 70. The port eccentric block 32 and the starboard eccentric cleat 34 are also mounted on the deck 71, each about seven inches forward of and seven inches laterally from the vertical axis of pivot 24. The radial block 33 is about twenty inches aft of the vertical axis of pivot 24.

A second sail tension line, an outhaul 40, is led from the clew 65 of the sail 60, over a distal line restraining means, in this case two distal sheaves 41, at the distal end 82 of the boom 22; along the underside of the boom 22; through a radial line restraining means, a radial channel guide 42; to an eccentric line restraining means, the forward edge 25 of the mast 21, and above at least part of a vertical line restrainer 26 at the forward edge 25 of the mast 21 and at about the height of the boom 22; and then to a radial line restraining means, a radial cleat 46. The radial channel guide 42 and radial cleat 46 are on the boom about sixteen inches aft of the vertical axis of pivot 24 of the boom 22. The sail 60 is also attached at the distal end 82 of the boom 22 with a clew vertical restraining means, in this case a rod 43 about eight inches in length and three-eighths of an inch in diameter, mounted to the boom 22 at each of the rod's 43 ends, inclined upward at about a twenty degree angle from the boom 22 as it extends forward, and a shackle 44 connected around the rod 43 and to the clew 65.

The present invention also includes a vang means comprising a vang 50 led from a bale 51 on the boom about twenty-four inches aft of the vertical axis of pivot 24 to an eye 52 on the deck 71, close to where a projection of the vertical axis of pivot 24 would intersect the deck 71.

Because the tension on the leech 63 of a sail 60 is affected by the characteristics of several elements of the vessel's equipment, including the headstay 73, outhaul 40, and mast 21, it is difficult to specify a preferred embodiment of the vang 50. For the boat of FIG. 1, the presence of a headstay 73, shrouds 74, and a clew vertical restrainer with a twenty degree incline, suggest that the leech 63 will be eased less than an ideal amount with a vang that has no effect on the leech 63 tension. Consequently, the eye 52 to which the vang's 50 lower end is attached is about one inch forward of where a projection of the boom's 22 vertical axis of pivot would intersect the deck 71. If that is not feasible, the mounting eye 52 can be replaced with a bale or U bolt having an arc that allows the vang more transverse travel than fore-aft travel. Either arrangement will allow the distal end 82 of the boom 22 to rise some as the boom 22 is sheeted out, and in turn ease the tension along the leech 63 of the sail 60.

Figure 7:
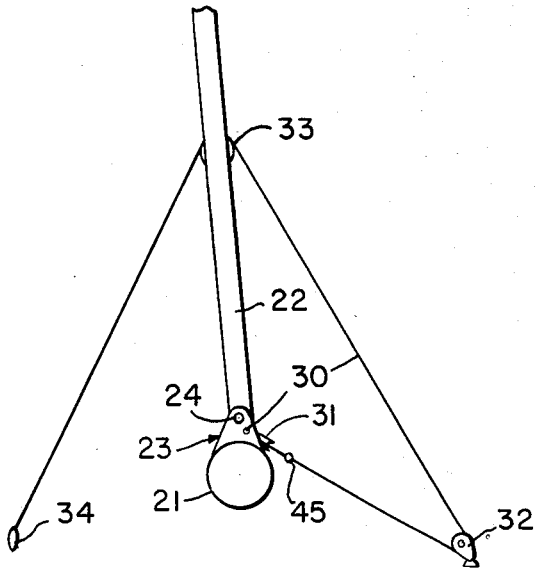
FIG. 7 is a schematic plan view of the cunningham arrangement of FIG. 1.
Figure 8:
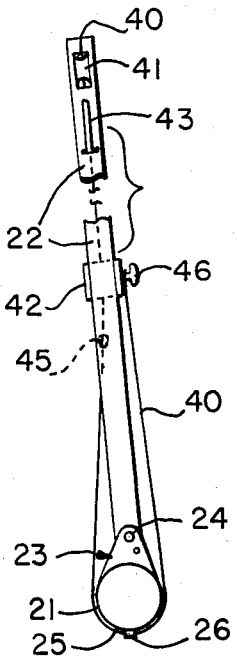
FIG. 8 is a schematic plan view of the outhaul arrangement of FIG. 1.

The cunningham 30 and outhaul 40 of FIGS. 1, 7, and 8 have radii that are eccentric to the boom's 22 vertical axis of pivot 24. As the boom 22 is sheeted out with the sheetline 72, rotating in the horizontal plane about its vertical axis of pivot 24, the total distance between the starboard eccentric cleat 34 and the radial block 33 and between the radial block 33 and the port eccentric block 32 decreases and thus eases the cunningham 30 through the central block 31. This allows the tack 64 to rise and reduces the tension along the luff 61 of the sail 60. As the boom 22 is sheeted out, the tension along the foot 62 of the sail 60 is reduced in two ways. In the horizontal plane, the foot 62 rotates about a vertical axis at the transverse center of the aft edge of the mast 21, but the boom 22 rotates about its vertical axis of pivot 24 which is a modest distance aft of the mast. As a result of that eccentricity, the distal end 82 of the boom 22—and all other points on the boom aft of the vertical axis of pivot 24—gradually become closer to the aft edge of the mast as the boom 22 is sheeted out, thereby moving the clew 65 closer to the tack 64 and reducing the tension along the foot 62. In addition, as the boom 22 is sheeted out, the distance from the radial channel guide 42 around the forward edge 25 of the mast 21 and back to the radial cleat 46 decreases, thus easing the outhaul 40 through the radial channel guide 42. This allows the shackle 44 on the clew 65 to slide forward on the rod 43, further easing the clew 65 towards the tack 64, and further reducing the tension along the foot 62.

A stop 45 is affixed to the cunningham 30 between the central block 31 and the port eccentric block 32, such that after the cunningham 30 has been eased about four inches, the stop engages the central block 31 and the cunningham 30 is not further eased through that block. A second stop 45 is also affixed to the outhaul 40 somewhat forward of where it passes through the radial channel 42, such that after the outhaul 40 has been eased about five inches, the stop 45 engages the radial channel guide 42 and the outhaul is not further eased through the radial channel guide 42. The stops can be a knot in the sail tension line, or a device that secures to the line.

The automated cunningham control mechanism and the automated outhaul control mechanism, as herein described, release the tack and clew of a sail by amounts that are close to what is generally thought to be ideal as the boom is sheeted from hard in until it is sheeted out to about a forty-five degree angle. But as the boom is sheeted out farther, the amounts of release would become somewhat excessive without stops. The approximate amounts of release, with and without the stops, are indicated below:

| Horizontal Boom Angle | Vertical Tack Release | | Horizontal Clew Release | |
|---|---|---|---|---|
| | 4" stop | no stop | 5" stop | no stop |
| 30° | 1⅛" | 1⅛" | 1" | 1" |
| 45° | 2⅛" | 2⅛" | 2½" | 2½" |
| 90° | 4" | 6" | 5⅜" | 7⅛" |

Figure 2:
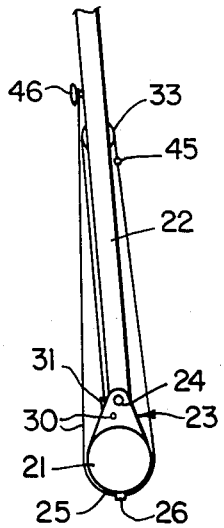
FIG. 2 is a schematic plan view of an alternative cunningham mechanism of the present invention.
Figure 3:
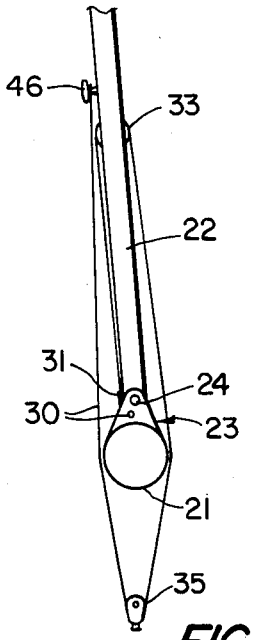
FIG. 3 is a schematic plan view of a second alternative cunningham mechanism of the present invention.
Figure 4:
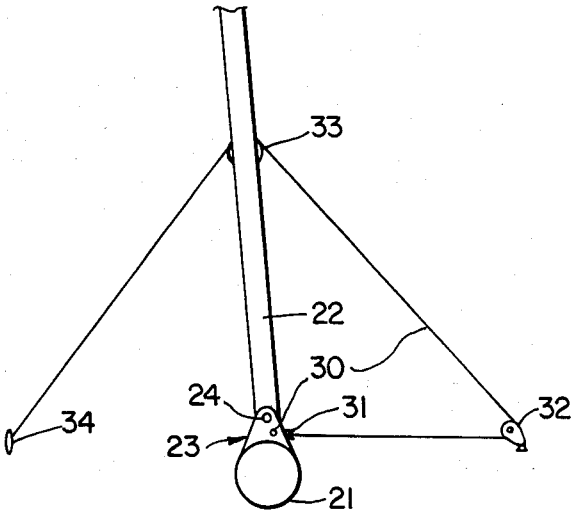
FIG. 4 is a schematic plan view of a third alternative cunningham mechanism of the present invention.
Figure 5:
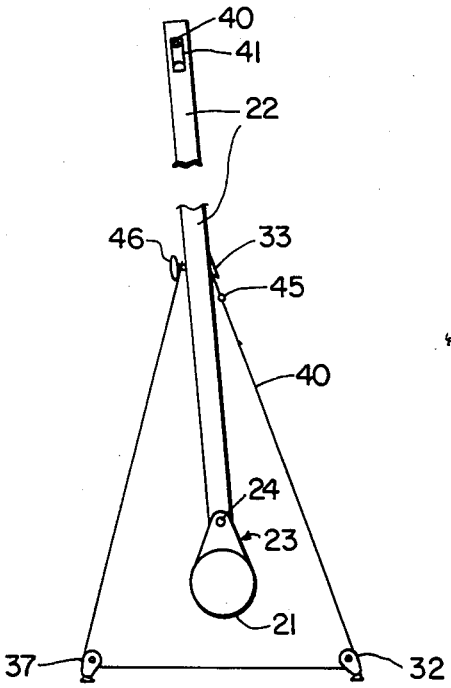
FIG. 5 is a schematic plan view of an alternative outhaul mechanism of the present invention.

FIGS. 2, 3, 4, and 5 show alternative ways of leading sail tension lines so that they are automatically tensioned and eased, as the boom is sheeted in and out, respectively. FIG. 2 shows a cunningham arranged much like the outhaul is in FIGS. 1 and 8. The cunningham 30 is led down through the gooseneck 23 and through a central block 31 a few inches below the gooseneck 23, then aft to a radial block 33 on the boom 22, then to port around the eccentric forward edge 25 of the mast 21 above at least part of a vertical line restrainer 26 positioned at about the height of the boom 22, then to a radial cleat 46 on the boom 22. FIG. 3 shows a cunningham 30 led down through the gooseneck 23 and through a central block 31 a few inches below the gooseneck 23, then aft to a radial block 33 on the boom 22, then port of the mast 21 to an amidships eccentric block 35 on the deck 71, and then starboard of the mast 21 to a radial cleat 46 on the boom 22. FIG. 4 shows a cunningham 30 led down on the port side of the gooseneck 23, to a central block 31 on the deck 71, to a port eccentric block 32 on the deck 71 about directly abreast of the boom's 22 vertical axis of pivot, then to a radial block 33 on the boom 22, and then to a starboard eccentric cleat 34 on the deck 71 about directly abreast of the vertical axis of pivot. FIG. 5 shows an outhaul arranged in a manner somewhat like the cunningham shown in FIGS. 1 and 7. The outhaul 40 is led down over distal sheaves 41 at the distal end 82 of the boom 22, forward through a radial block 33 on the boom 22, then to a port eccentric block 32 on the deck 71, then to a starboard eccentric block 37 on the deck 71, and then to a radial cleat 46 on the boom 22.

Figure 6:
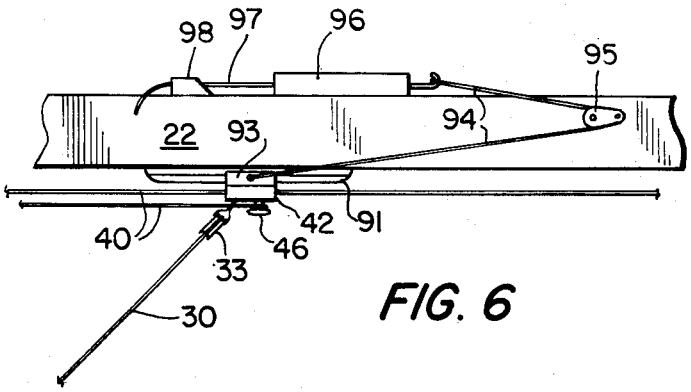
FIG. 6 is an enlarged fragmentary side elevation view of a preferred embodiment similar to that of FIG. 1, but with the addition of a device permitting simultaneous tensioning and easing of the cunningham and outhaul with a single manual adjustment.

FIG. 6 shows one preferred embodiment of a means for moving the radial line restraining means on the boom with one adjustment, such that the cunningham and outhaul can be simultaneously tensioned or eased. The cunningham 30 and outhaul 40 are rigged essentially as in FIG. 1, except that the radial channel guide 42, radial cleat 46, and radial block 33 are mounted on a sliding car 93. The car 93 slides on a short track 91 which is affixed to the boom 22. A bridle 94 is connected to both sides of the car 93, and is led to a turning block 95 on each side of the boom 22 about a foot aft of the track 91, and then to a power box 96 such as the "Magic Box" manufactured by Vanguard Inc. under the "HARKEN" trademark. The adjusting lead 97 of the power box 96 is secured with a clam cleat 98.

There are at least five ways in which the automated sail tension line control mechanism can be modified to increase the amount of release. The boom's vertical axis of pivot can be moved farther aft of the mast, the eccentric line restraining means can be moved farther forward of or abreast from the vertical axis of pivot, the radial line restraining means can be moved farther aft of the vertical axis of pivot, the sail tension line can be led through the eccentric geometry a second time or through another eccentric geometry before being secured, and the vertical angle of the sail tension lines led to the eccentric line restraining means on the deck can be reduced by lowering the boom or raising the eccentric line restraining means off the deck.

The foot of a sleeve-type sail pivots about an axis at the center of the mast, whereas the foot of most other sails pivots at the transverse center of the aft edge of the mast. Consequently for any given embodiment of the present invention, the tension along the foot of a sleeve-type sail will be eased more at a given horizontal boom angle than the tension along the foot of most other sails.

When there is substantial friction within the mechanism, the amount of release at a given boom angle will be less when sheeting out to the angle than when sheeting in to it. A "TEFLON" coating or nylon bushing can reduce the friction of a lead about the mast. Properly sized, good quality, ball bearing blocks are preferred. When a lead runs from the boom to a central block a few inches under the gooseneck, that block should be the swivel type. Some of the other blocks may also need to be the swivel type for certain possible arrangements. The line restraining means should be mounted to minimize lines chafing against each other.

If the sail tension lines stretch, the mechanism will not move the tack and clew of the sail to the extent intended. Since the lines are considerably longer than their manually adjusted counterparts, they preferably should be one diameter size larger, and of the lowest stretch material possible. "Prestretched" "DACRON" line and "KEVLAR" line would be good choices.

The automated sail tension control system can be rigged as follows. If there is a device to move the radial line restraining means, it is set for medium winds. After the sail is hoisted, the outhaul is led through the appropriate line restraining means and tensioned about as tight as possible. The shackle on the clew of the sail is connected to the rod on the distal end of the boom. The vang is connected to the boom and tightened. The cunningham is led through the appropriate line restraining means and tightened. Then the boat is sailed on a beat and the control lines are adjusted manually to get the ideal sail camber for the prevailing wind. If stops are to be used and they are not permanently affixed to the control lines, they are positioned and secured.

The vang must be set so that it is taut when the boom is sheeted hard in on a beat. Otherwise, as the sail is sheeted out, the boom will rotate up and tighten the sail tension lines led from the boom to the deck, or at least counter some of the release they are supposed to experience.

The present invention automatically adjusts the sail tensions for different headings of the vessel. It also automatically adjusts the sail tensions some for variations in wind velocity. This is because as the wind increases, the boom generally is sheeted in more for any given heading, and thus the tensions are increased, just as good practice dictates. The amount of adjustment, however, especially when beating, will usually not be enough for substantial changes in the wind velocity. Additional adjustments can be made manually under these circumstances.

It is to be understood that various changes can be made in the form, construction, and arrangement of parts of the apparatus described hereabove without departing from the spirit and scope of the invention or sacrificing all its material advantages, the description being merely preferred or exemplary embodiments thereof.

I claim:

1. An automated sail tension control mechanism for a sailing vessel comprising:

a mast;

a boom with a forward end and a connection at said forward end to said mast;

a vertical axis of pivot for said boom at said connection;

at least one radial line restraining means on said boom substantially aft of said vertical axis of pivot;

at least one eccentric line restraining means disposed substantially from said boom's vertical axis of pivot and within approximately 90 degree arcs from directly forward of said vertical axis of pivot; and at least one sail tension line led twice directly between said radial line restraining means and said eccentric line restraining means, once to each side of said mast, such that as said boom is sheeted in and out, on either side of the sailing vessel, said sail tension line is substantially tensioned and eased, respectively.

2. The control mechanism as recited in claim 1, wherein said vertical axis of pivot for said boom is about two to three times the normal distance aft of said mast, thereby accelerating the tensioning and easing of said sail tension line as said boom is sheeted in and out.

3. The control mechanism as recited in claim 1, wherein said mast has a forward edge, said eccentric line restraining means is said forward edge, and part of said sail tension line is led from a first said radial line restraining means to around said forward edge of said mast, and then to the first said radial line restraining means or to another said radial line restraining means.

4. The control mechanism as recited in claim 1, wherein said eccentric line restraining means is disposed about directly forward of said mast and part of said sail tension line is twice led between a said radial line restraining means and said eccentric line restraining means, once on each side of said mast.

5. The control mechanism as recited in claim 1, wherein said eccentric line restraining means are at least two in number and disposed both forward of and laterally from said vertical axis of pivot, with one to each side of the vessel, and wherein part of said sail tension line is led between said radial line restraining means and each said eccentric line restraining means.

6. The control mechanism as recited in claim 1, wherein said eccentric line restraining means are at least two in number and disposed about directly abreast of said vertical axis of pivot, with one to each side of the vessel, and wherein part of said sail tension line is led between said radial line restraining means and each said eccentric line restraining means.

7. An automated cunningham control mechanism for a sailing vessel, comprising:

a mast;

a boom with a forward end and a connection at said forward end to said mast;

a vertical axis of pivot for said boom at said connection;

at least one radial line restraining means on said boom substantially aft of said vertical axis of pivot;

at least one eccentric line restraining means disposed substantially from said boom's vertical axis of pivot and within approximately 90 degree arcs from directly forward of said vertical axis of pivot, and a cunningham led directly between said radial line restraining means and said eccentric line restraining means, such that as said boom is sheeted in and out, on either side of the sailing vessel, said cunningham is tensioned and eased, respectively and gradually to a maximum distance of about six percent of the length of said boom.

8. The control mechanism as recited in claim 7, wherein said vertical axis of pivot for said boom is about two to three times the normal distance aft of said mast, thereby accelerating the tensioning and easing of said cunningham as said boom is sheeted in and out.

9. The control mechanism as recited in claim 7, further comprising a stop affixed to said cunningham a distance of about three to seven percent of the length of said boom, when said cunningham is fully tensioned, from one said radial line restraining means through which said cunningham passes, such that after said cunningham has been eased automatically a predetermined amount, said stop will engage said radial line restraining means and said cunningham will not be further eased through said radial line restraining means.

10. The control mechanism as recited in claim 7, further comprising a central line restraining means about immediately aft of said mast and below said boom;

wherein said eccentric line restraining means are at least two in number and disposed both substantially forward of and laterally from said vertical axis of pivot, with one to each side of the vessel; and wherein said cunningham is led to said central line restraining means, then to one said eccentric line restraining means, then to said radial line restraining means, and then to said other eccentric line restraining means.

11. The control mechanism as recited in claim 7, further comprising a central line restraining means about immediately aft of said mast and below said boom;

wherein said mast has a forward edge and said eccentric line restraining means is said forward edge;

further comprising a vertical line restrainer on said mast about at the height of said boom; and wherein said cunningham is led to said central line restraining means, then to a first said radial line restraining means, then around said forward edge of said mast above at least part of said vertical line restrainer, and then to the first said radial line restraining means or to another said radial line restraining means.

12. An automated outhaul control mechanism for a sailing vessel, comprising:

a mast;

a boom with a forward end and a connection at said forward end to said mast;

a vertical axis of pivot for said boom at said connection;

at least one radial line restraining means on said boom substantially aft of said vertical axis of pivot;

at least one eccentric line restraining means disposed substantially from said boom's vertical axis of pivot and within approximately 90 degree arcs from directly forward of said vertical axis of pivot; and an outhaul led directly between said radial line restraining means and said eccentric line restraining means, such that as said boom is sheeted in and out, on either side of the sailing vessel, said outhaul is tensioned and eased, respectively and gradually to a maximum distance of about seven percent of the length of said boom.

13. The control mechanism as recited in claim 12, wherein said vertical axis of pivot for said boom is about two to three times the normal distance aft of said mast, thereby accelerating the tensioning and easing of said outhaul as said boom is sheeted in and out.

14. The control mechanism as recited in claim 12, further comprising a stop affixed to said outhaul a distance of about three to seven percent of the length of said boom, when said outhaul is fully tensioned, from one said radial line restraining means through which said outhaul passes, such that after said outhaul has been eased automatically a predetermined amount, said stop will engage said radial line restraining means and said outhaul will not be further eased through said radial line restraining means.

15. The control mechanism as recited in claim 12, wherein said boom has a distal end, and further comprising a clew vertical restraining means at about said distal end, said outhaul being vertically restrained by said clew vertical restraining means.

16. The control mechanism as recited in claim 12, wherein said boom has a distal end;

further comprising a distal line restraining means at about said distal end;

wherein said eccentric line restraining means are at least two in number and disposed both substantially forward of and laterally from said vertical axis of pivot, with one to each side of the vessel; and wherein said outhaul is lead to said distal line restraining means, then to a first said radial line restraining means, then to one said eccentric line restraining means, then to said other eccentric line restraining means, and then to the first said radial line restraining means or to another said radial line restraining means.

17. The control mechanism as recited in claim 12, wherein said boom has a distal end;

further comprising a distal line restraining means at about said distal end;

wherein said mast has a forward edge and said eccentric line restraining means is the forward edge of said mast;

further comprising a vertical line restrainer on said mast at about the height of said boom; and wherein said outhaul is led to said distal line restraining means, then to a first said radial line restraining means, then around said forward edge of said mast above at least part of said vertical line restrainer, and then to the first said radial line restraining means or to another said radial line restraining means.

18. An automated sail tension control system for a sailing vessel, comprising:

a mast;

a boom with a forward end and a connection at said forward end to said mast;

a vertical axis of pivot for said boom at said connection;

at least one radial line restraining means on said boom substantially aft of said vertical axis of pivot;

at least one eccentric line restraining means disposed substantially from said boom's vertical axis of pivot and within approximately 90 degree arcs from directly forward of said vertical axis of pivot; and a cunningham led directly between said radial line restraining means and said eccentric line restraining means; and an outhaul led twice directly between said radial line restraining means and said eccentric line restraining means, once to each side of said mast;

such that as said boom is sheeted in on either side of the sailing vessel, said cunningham and said outhaul are substantially tensioned, and when said boom is sheeted out on either side of the vessel, said cunningham and said outhaul are substantially eased.

19. The control system as recited in claim 18, wherein said boom has a distal end, and further comprising a vang means for automatically adjusting the vertical level of said distal end, as said boom is sheeted in and out on either side of the sailing vessel.

20. The control system as recited in claim 18, wherein said vertical axis of pivot for said boom is about two to three times the normal distance aft of said mast, thereby accelerating the tensioning and easing of said cunningham and said outhaul as said boom is sheeted in and out.

21. The control system as recited in claim 18, further comprising a means for moving said radial line restraining means on said boom with one adjustment, thereby permitting manual tensioning or easing of both said cunningham and said outhaul simultaneously.

* * * * *